US007663504B2

(12) United States Patent
Votaw et al.

(10) Patent No.: US 7,663,504 B2
(45) Date of Patent: Feb. 16, 2010

(54) EMERGENCY VEHICLE WARNING SYSTEM

(76) Inventors: Sean Robert Votaw, 4214 Toyah Ct., Concord, CA (US) 94521; Ronald Raymond Shea, 6244 Royal Oak Ct., San Jose, CA (US) 95123

( * ) Notice: Subject to any disclaimer, the term of this patent is extended or adjusted under 35 U.S.C. 154(b) by 186 days.

(21) Appl. No.: 11/298,060

(22) Filed: Dec. 8, 2005

(65) Prior Publication Data

US 2007/0132608 A1 Jun. 14, 2007

(51) Int. Cl.
*G08G 1/00* (2006.01)

(52) U.S. Cl. ..... 340/902; 340/903

(58) Field of Classification Search ..... 340/902–903, 340/906, 539

See application file for complete search history.

(56) References Cited

U.S. PATENT DOCUMENTS 5,453,740 A * 9/1995 Gallagher et al. ..... 340/903
6,087,961 A * 7/2000 Markow ..... 340/902
6,333,703 B1 * 12/2001 Alewine et al. ..... 340/995.13
2005/0073432 A1 * 4/2005 Melman ..... 340/902
2006/0132294 A1 * 6/2006 Spark ..... 340/426.1
2006/0161335 A1 * 7/2006 Beinhaker ..... 701/200

* cited by examiner

*Primary Examiner*—Daniel Wu
*Assistant Examiner*—Shirley Lu
(74) *Attorney, Agent, or Firm*—Ronald R. Shea, Esq.

(57) ABSTRACT

An emergency vehicle transmits a Vehicle Present Signal when in transit on public roads responding to an emergency. The signal can include information relating to the type of emergency vehicle, local highway and terrain data, and the location, speed and direction of travel of the emergency vehicle. When the Vehicle Present Signal is detected by a first vehicle, a functional circuit within the first vehicle calculates the distance between the emergency vehicle and the first vehicle. If the vehicles are within a predetermined distance, a warning signal activates one or more warning systems, thereby notifying the driver of the first vehicle that an emergency vehicle is in the vicinity. A dead-band defined by first and second predetermined distances can be incorporated to prevent rapid cycling of the warning signal.

32 Claims, 6 Drawing Sheets

EMERGENCY VEHICLE WARNING SYSTEM

BACKGROUND OF THE INVENTION

1. Field of the Invention

The present invention is directed to the field of traffic safety. More specifically, the present invention is directed to a method and apparatus for improving traffic safety when emergency vehicles are transiting streets and highways.

2. Description of the Prior Art

Emergency vehicles such as police cars, fire trucks, and ambulances must navigate public roads in emergency conditions. Sirens have been used for decades as a means to warn other drivers and pedestrians of the proximity of the emergency vehicle. However, as vehicle comfort and "ergonomics" becomes a higher priority in automobile manufacturing, sound resistant construction of newer cars can inhibit the siren sound from penetrating the cabins and coaches of many vehicles. Additionally, the use of radios, CD players, head sets, and other audio entertainment devices can serve to drown-out the sound of a siren of a nearby emergency vehicle.

BRIEF SUMMARY OF THE INVENTION

An emergency vehicle transmits a Vehicle Present Signal when responding to an emergency. The Signal can include information relating to the type of emergency vehicle, local highway and terrain data, and the location, speed and direction of travel of the emergency vehicle. When the Vehicle Present Signal is detected by a first vehicle, a functional circuit within the first vehicle calculates the distance between the emergency vehicle and the first vehicle. If the distance falls within a predetermined range, a warning signal is activated, notifying the driver of the first vehicle that an emergency vehicle responding to an emergency is in the vicinity. The warning signal can activate a warning light or a more complex graphic visual display, reduce the volume of an audio broadcast within the first vehicle, initiate the broadcast of an audio warning, or activate a mechanical vibrator within the first vehicle.

A method of warning drivers of the proximity of an emergency vehicle engaging in emergency activity comprises the step of transmitting a Vehicle Present Signal. A first vehicle proximate the emergency vehicle has a receiver that receives the Vehicle Present Signal. A processing member within the first vehicle processes information in the Vehicle Present Signal to determine if the emergency vehicle has come within a first predetermined distance of the first vehicle. A functional circuit within the first vehicle generates a warning signal if the emergency vehicle has come within the first predetermined distance of the first vehicle.

The Vehicle Present Signal comprises data which can include, but is not limited to, a type of emergency vehicle, a location of the emergency vehicle, a speed of the emergency vehicle, a direction of travel of the emergency vehicle, information of roads, highways, bridges, overpasses, underpasses, highway construction, one-way streets, railroads and landmarks proximate the emergency vehicle, and combinations thereof.

The warning signal generated by the functional circuit activates a warning in the form of a warning light that turns on in proximity of an emergency vehicle, a graphic visual display, an audio warning, a mechanical warning, or combinations thereof. The audio warning is broadcast from an audio speaker within the first vehicle, and can include a sound descriptive of a type of emergency vehicle, or language describing any of the various data relating to the emergency vehicle as discussed herein. The graphic visual display can include, but is not limited to, a description of a type of emergency vehicle proximate the first vehicle, a straight line distance between the first vehicle and the emergency vehicle, a path of travel distance between the first vehicle and the emergency vehicle over existing highways, a position or direction of the emergency vehicle relative to the first vehicle, a speed of the emergency vehicle relative to the earth, a speed of the emergency vehicle relative to the first vehicle, and combinations thereof.

According to one embodiment, prior to the step of transmitting the vehicle present signal by the emergency vehicle, an audio-signal generator within the first vehicle is transmitting a user-selected signal to the audio speaker, thereby broadcasting a user-selected sound at a first volume from the audio speaker. If the emergency vehicle has come within the first predetermined distance of the first vehicle, the warning signal generated by the functional circuit reduces a volume of the user-selected sound to a second volume that is less than the first volume.

A second predetermined distance greater than the first predetermined distance establishes a dead-band between the first and second predetermined distances. The warning that is activated by the functional circuit remains active until a space between the first vehicle and the emergency vehicle exceeds a second predetermined, thereby preventing rapid on-off cycling of the warning. If the distance between the first vehicle and the emergency vehicle has come to exceed a second pre-determined distance, the generation of the warning signal by the functional circuit is terminated.

An apparatus for warning an agent controlling a first vehicle of an emergency-vehicle proximate the first vehicle comprises a signal-generator coupled to the emergency vehicle. The signal generator is configured to generate a Vehicle Present Signal. A signal-receiver is coupled to the first vehicle for receiving the Vehicle Present Signal. The agent controlling the first vehicle can be a human driver or automated control system. A functional circuit is coupled to the signal-receiver for generating a warning signal. The functional circuit can include a range-finder for determining a distance from the first vehicle to the emergency-vehicle. According to one embodiment, the range-finder includes a signal measuring apparatus for measuring a signal strength of the Vehicle Present Signal signal. According to an alternative embodiment, the range finder includes a digital circuit for determining a distance between a first and second set of coordinates. The functional circuit comprises a signal generator for generating a warning signal that is in signal continuity with an output device selected from among a group of output devices consisting of a warning light, an audio speaker, a graphic visual display, a mechanical output device, and combinations thereof. The functional circuit comprises a digital storage member for storing digital data, and a processing member for processing the digital data.

The first vehicle comprises an audio-signal generator, an audio-speaker, and a signal path having electrical continuity from the audio-signal generator to the audio-speaker. The functional circuit comprises a switch means for interrupting the electrical continuity between the audio signal generator and the audio speaker.

Other aspects and advantages of the present invention will become apparent from the following detailed description, taken in conjunction with the accompanying drawings, illustrated by way of example of the principles of the invention.

BRIEF DESCRIPTION OF THE SEVERAL VIEWS OF THE DRAWINGS

Throughout the description similar reference numbers may be used to identify similar elements.

DETAILED DESCRIPTION

Figure 1:
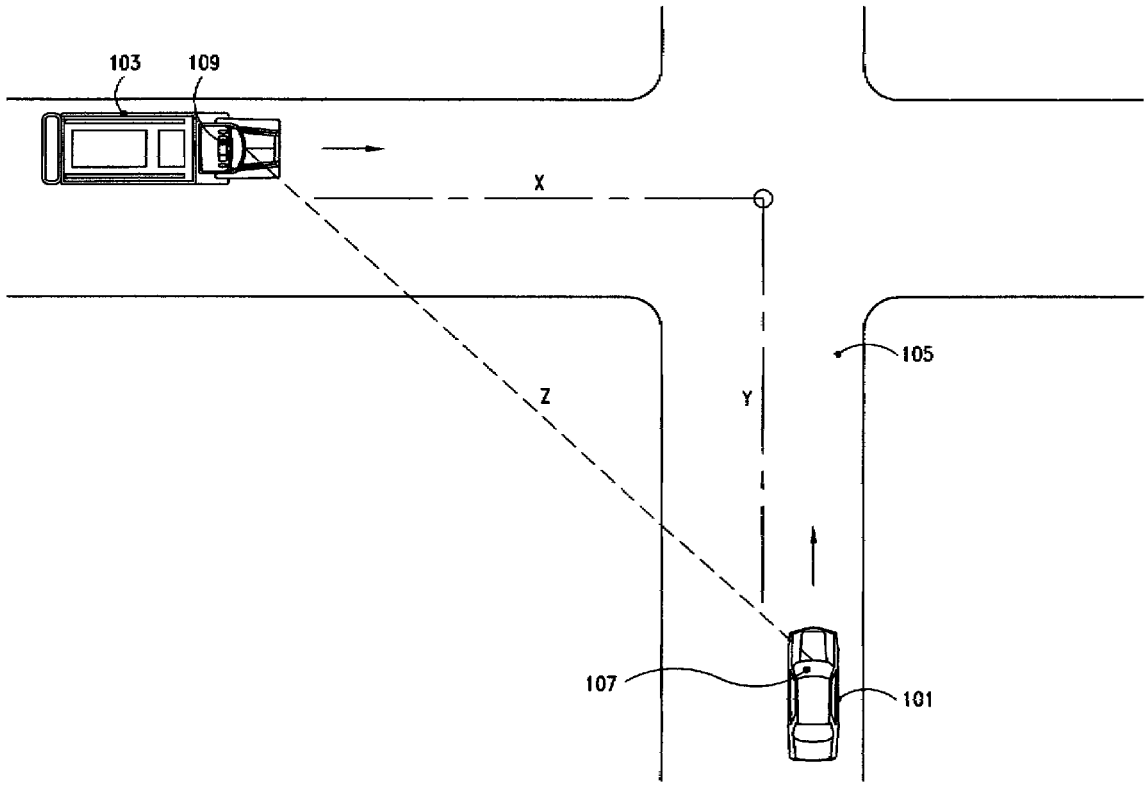
FIG. 1 is a top plan view of a first vehicle in proximity to an emergency vehicle.

FIG. 1 shows a first vehicle 101 driven by a driver 107 over a public road 105 and an emergency vehicle 103 shown as a fire truck having a siren 109. The "over the road" distance between the first vehicle and the emergency vehicle is the sum of distances X plus Y. The straight line distance between the first vehicle and the emergency vehicle is shown as the distance Z.

Figure 2:
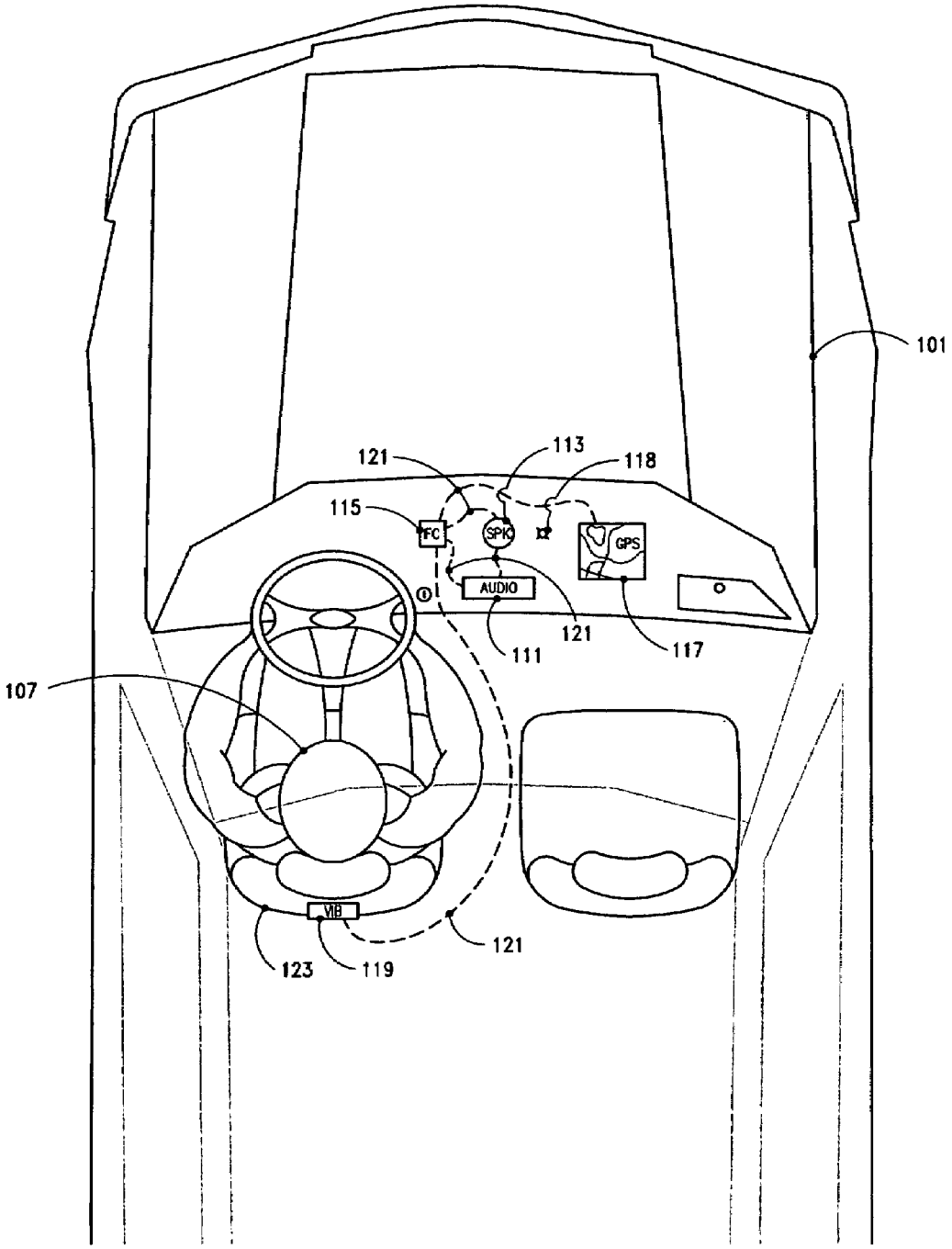
FIG. 2 is a more detailed view of the first vehicle of FIG. 1 with a driver and an emergency vehicle warning system.

FIG. 2 shows the first vehicle 101 of FIG. 1 in greater detail. The first vehicle 101 has an audio system 111 broadcasting sound through the audio speaker 113. Additionally, the first vehicle 101 is partially sound resistant, insulating the interior cabin space from outside noises. As a result, it is difficult for the driver 107 to hear the siren 109 of the emergency vehicle 103. Sound resistant vehicles, or an audio system active within a vehicle can impede a driver's ability to hear a siren or determine the direction from which the sound is being generated. This creates a dangerous situation on public roads. The audio speaker illustrated in FIG. 2 can be integrally affixed to vehicle 1, or may be a portable speaker, head phone set, ear phone, portable hand-held unit, boom-box, or combinations thereof. The audio speaker 113 is coupled to the audio system 111 by interconnecting wire 121.

A warning system includes one or more warning indicators, including, but not limited to, a warning light 118, a graphic visual display 117, an audio warning system 111, and a mechanical vibrator 119. The location of the vibrator within the back of the driver's seat 123 in FIG. 2 is exemplary. In practice, the vibrator is disposed in any location within the first vehicle where the vibration will be sensed by the driver. According to an embodiment, a functional circuit 115 for controlling the one or more warning indicators is in signal continuity with the various warning indicators by a communication channel shown in FIG. 2 as signal bus 121. The signal bus is exemplary, and the communication channel can include single or multi channel electrical paths, optical paths, wireless signal paths, or combinations thereof.

Figure 3A:
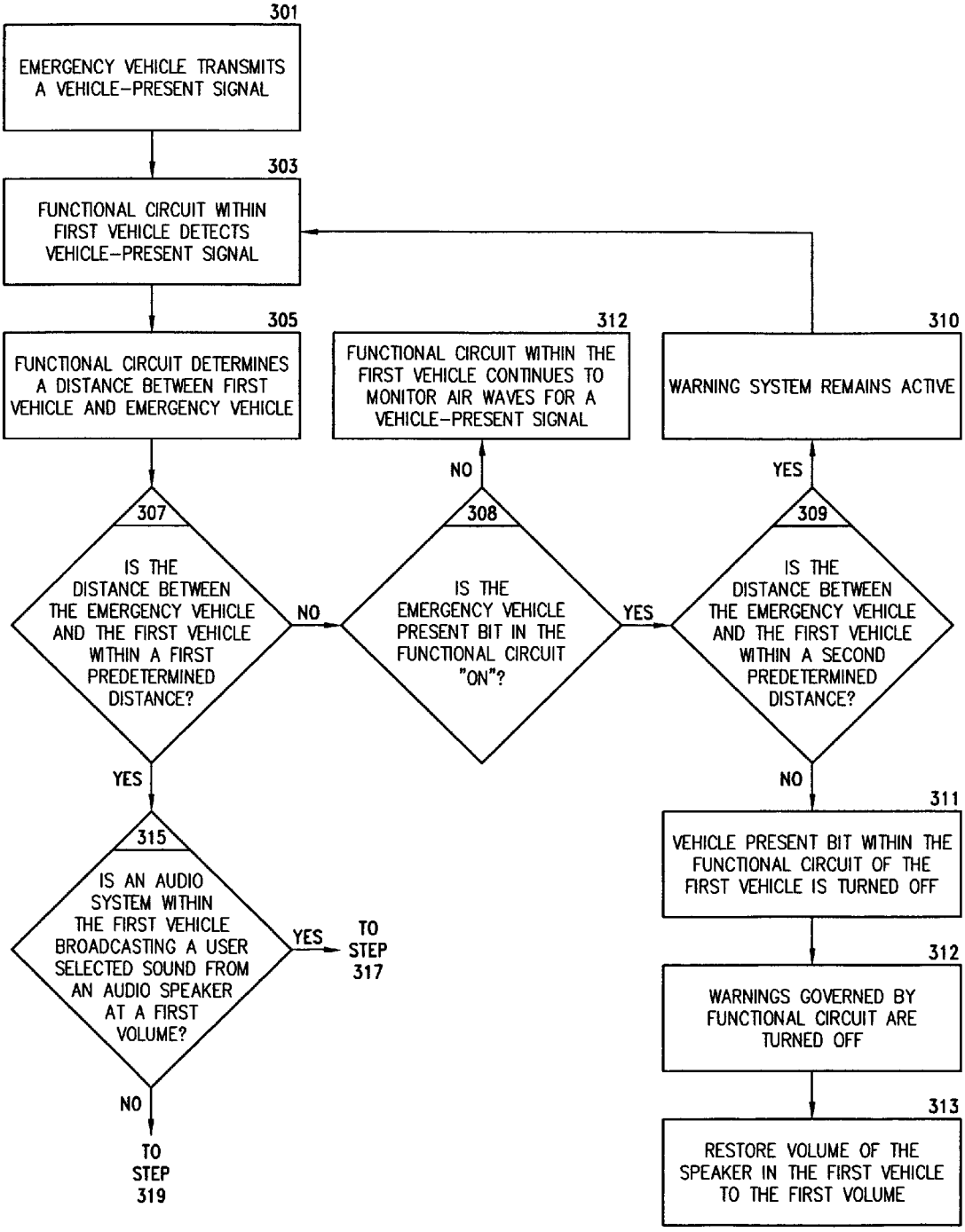
FIG. 3 is a flow chart depicting a method for warning the driver of FIG. 1 of the proximity of the emergency vehicle of FIG. 1.
Figure 3B:
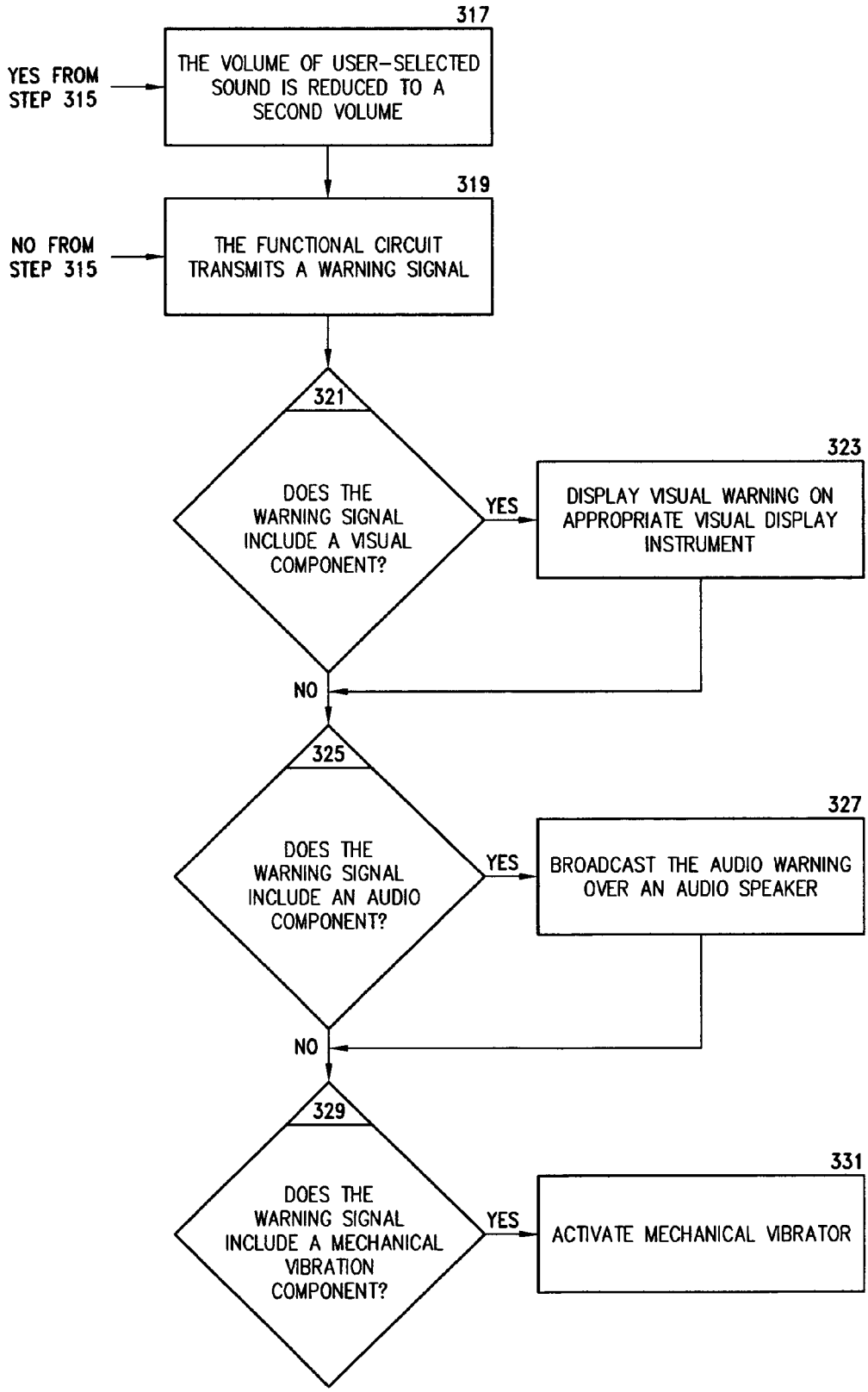

FIG. 3 is a flow chart depicting a method for alerting an agent controlling a first vehicle 101 of the presence of emergency vehicle 103 within the vicinity of the first vehicle 101. The agent may be a human driver, or an automated system that is used to control the first vehicle. In step 301, the emergency vehicle transmits a Vehicle Present Signal is transmitted by a signal transmitter. According to an embodiment, the transmitter can be disposed within the emergency vehicle itself. According to an alternative embodiment, the emergency vehicle transmits relevant data to a relay or other transmitting station, including but not limited to an orbiting satellite, a mobile base station, or a fixed base station. The Vehicle Present Signal is then transmitted by the alternative transmission station. The Vehicle Present Signal can include, but is not limited to, data describing a type of emergency vehicle, a location of the emergency vehicle, a speed of the emergency vehicle, direction of travel of the emergency vehicle, information of roads, highways, bridges, overpasses, underpasses, highway construction, one-way streets, railroads and landmarks proximate the emergency vehicle.

According to an embodiment, a government regulatory agency, legislative body, or private sector standards committee will establish standards and protocols defining specific characteristics of the vehicle present signal. This will ensure that vehicles can travel throughout a country, or even through multiple countries and find their emergency vehicle warning system fully functional. These standards may include a frequency or frequencies at which the Vehicle Present Signal is generated, as well as digital characteristics and envelope details. A Vehicle Present Signal can be in the form of multiple signals. An exemplary multiple signal format would include a detailed update signal containing more detailed information about roads and landmarks discussed above, and a limited update signal containing more limited information, such as information relating to the location, speed, and direction of travel of the emergency vehicle. In multiple signal embodiments, the detailed update signal can be transmitted less frequently than the limited update signal.

In the step 303, the functional circuit 115 (shown in FIG. 5) within the first vehicle 101 detects the Vehicle Present Signal 502. In the step 305, a distance between the emergency vehicle and the first vehicle is calculated. The calculation of step 305 is preferably performed within the functional circuit of the first vehicle. However, embodiments are envisioned wherein a distance is calculated by the emergency vehicle and transmitted to the first vehicle. According to an embodiment, the distance between the emergency vehicle and the first vehicle is determined by a signal strength of the Vehicle Present Signal received by the first vehicle. According to another embodiment, the distance between the emergency vehicle and the first vehicle is determined by round-trip ping and response time between the first vehicle 101 and the emergency vehicle 103. Because of the delay involved in digital signal processing, particularly in systems wherein a microprocessor multi-tasks through time-multiplexing, a ping-response embodiment will require a standardized signal processing time that is sufficiently short as to allow reasonably short distances to be meaningfully measured.

In yet another range-finding embodiment, the distance between the emergency vehicle and the first vehicle is calculated by using the GPS location of the emergency vehicle and a GPS location of the first vehicle. In GPS embodiments, the distance between the emergency vehicle and the first vehicle can be the shortest geometric (straight line) distance Z shown in FIG. 1, or can include a path of travel distance between the emergency vehicle and the first vehicle over local roads and highways connecting the emergency vehicle and the first vehicle, shown in FIG. 1 as distance X plus Y. Within this specification, specific details relating to GPS location and navigation systems are exemplary, and are not intended to limit the spirit and scope of the appended claims, which fully comprehend the use of alternative navigation and location systems, including, but not limited to, Loran, Omega, inertial navigational systems, as well as navigational systems that are not yet developed, or not commonly used.

In the step 307, the distance between the emergency vehicle is compared to a first predetermined distance. The distance between the emergency vehicle and the first vehicle can be calculated according to the "over-highway" distance, shown on FIG. 1 as the sum of X=Y, or the straight line distance, shown on FIG. 1 as Z. If, in the step 307, the emergency vehicle is not within a first predetermined distance shown in greater detail in FIG. 4, then, in the step 308, the process examines the state of the Vehicle-Present Bit 513 (FIG. 5) within the functional circuit 115 of the first vehicle. If the Emergency Vehicle Present Bit is "on," the process advances to step 309, where a distance between the emergency vehicle and the first vehicle is compared to a second predetermined distance that is greater than the first predetermined distance. The incorporation of first and second predetermined distances form in the process of FIG. 3 forms a "dead band" that prevents a warning system from cycling on and off, as discussed further in conjunction with FIG. 4.

Within step 309, if a distance between the emergency vehicle and the first vehicle is within the second predetermined distance, in step 310 the warning system remains active, and the process returns to step 303. If the distance between the emergency vehicle and the first vehicle is not within the second predetermined distance in Step 309, then, in the step 311, the Emergency Vehicle Present Bit within the functional circuit 115 of the first vehicle 101 is turned off. In step 312, the warning is deactivated within the first vehicle. The warning may be in the form of a single warning light, a visual signal or display, an audio signal, an interruption of a user selected audio broadcast, a vibration, or any combination therein.

In the step 313, a volume of a user-selected sound broadcast by audio speaker 113 within the first vehicle is restored to a first volume. User selected sound broadcasts can include, but are not limited to radio broadcasts, and broadcasts generated from sound recordings stored within the first vehicle. Because the warning signal produced by the functional circuit 115 (FIG. 5) can be in the form of packetized information in digital format, steps 312 of deactivating a warning, and step 313 of restoring the user-selected sound broadcast can be achieved variously be discontinuing the transmission of the warning signal, or transmitting information within the warning signal initializing the effects described in steps 312 and 313. The appended claims fully comprehend these equivalent processes.

Returning to step 308, if the Emergency Vehicle Present Bit 513 is off, then in the step 312, the functional circuit 115 continues to monitor the air waves for a vehicle-present signal.

Returning to step 307, if the distance between the emergency vehicle and the first vehicle is within the first predetermined distance, then, in step 315, if an audio speaker 113 within the first vehicle is broadcasting a user-selected sound at a first volume, then in the step 317, the volume of the user-selected sound is reduced to a second volume that is less than the first volume and the process advances to step 319. According to one embodiment, the second volume is zero dB. By reducing the volume on an audio system within the first vehicle 101, the driver 107 will be more able to hear a siren or other emergency warning device. Alternatively, the reduced volume will allow a driver to hear a warning broadcast over the audio system of the first vehicle, as discussed further below. Finally, the reduction of volume of a user-selected sound such as music or talk radio will, by itself, serve as a warning that an emergency vehicle is within the predetermined range.

Figure 5:
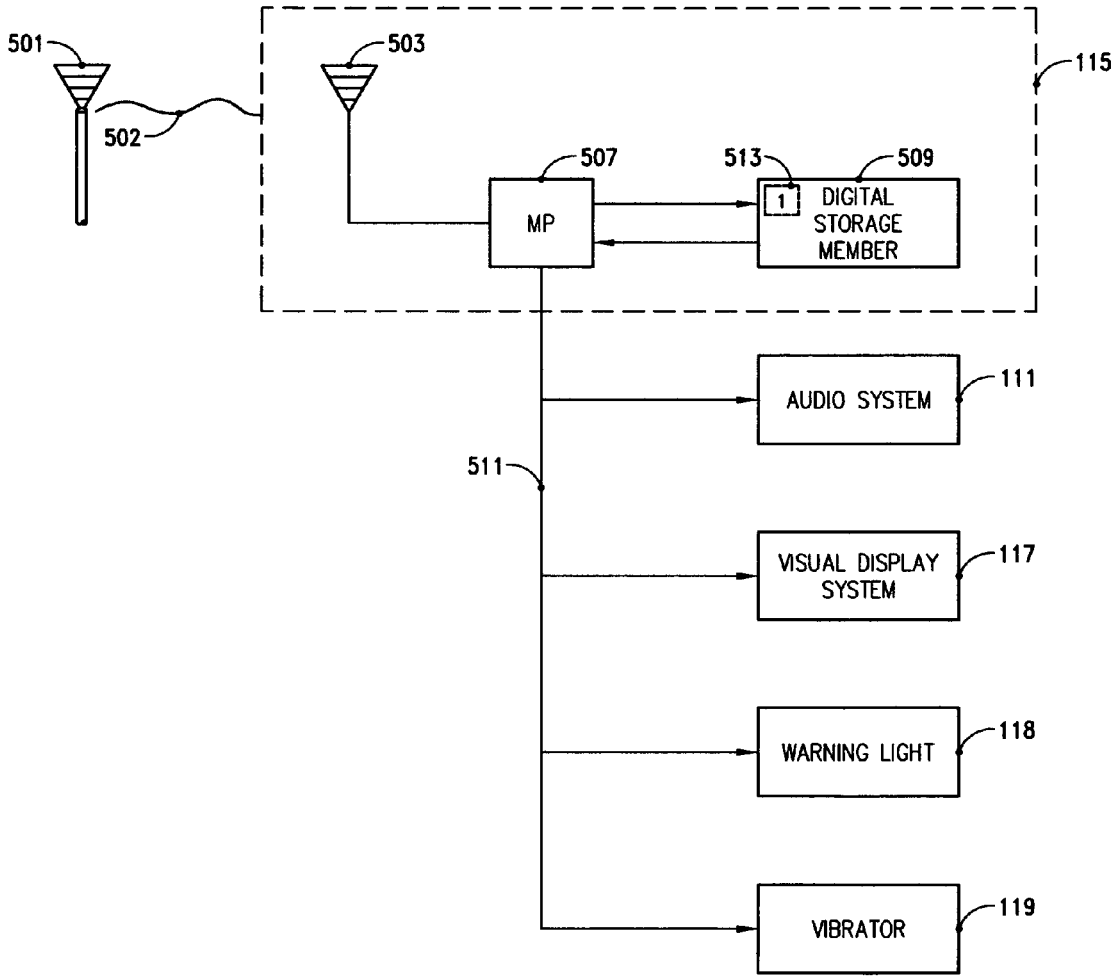
FIG. 5 is an illustration of a warning apparatus for implementing the process described in FIG. 3.

In the step 319, the functional circuit 115 shown in FIG. 5 transmits a warning signal. If, in the step 321, the warning signal includes a visual component, then in the step 323, a visual warning is displayed on an appropriate display instrument. The visual warning can include, but is not limited to, the activation of a simple warning light 118, a "range and direction" display such as commonly found on radar displays, or a graphic visual display 117. Graphic visual displays can include, but are not limited to, a direction of travel of the first vehicle, the position of the first vehicle, the position of the emergency vehicle, and topographical information that can include the graphical depiction of streets, roads, bridges, overpasses, underpasses, highway repairs, road condition, detours, one-way streets, new streets, discontinued streets, traffic lights, stop signs, railroad tracks, bodies of water and landmarks. In graphic visual displays incorporating a large amount of data, this data can be resident in a digital storage member 509 of the first vehicle and downloaded to the graphic visual display as needed, transmitted from the emergency vehicle to the first vehicle, or downloaded to the first vehicle from some other source. This information can be transmitted to the first vehicle as described in the step 301. The graphic visual display 117 will advantageously be interactive, including such features as zoom-in and zoom-out, and other menu options.

If, in the step 325, the warning signal comprises an audio component, then, in the step 327, an audio warning is broadcast over an audio speaker. The audio warning can include, but is not limited to, a simple sound such as a siren sound, a prerecorded message, a digitally synthesized message comprising information about a location, speed, or direction of travel of the emergency vehicle, and combinations thereof. Embodiments are envisioned wherein, prior to the step 303 of receiving the Vehicle Present Signal, the driver 107 presets the volume at which the warning is to be broadcast over the audio speaker 113, thereby ensuring that the warning is loud enough to be heard by the driver, but not so loud as to inflict pain on the driver, or otherwise interfere with the safe operation of the first vehicle.

In the step 329, if the warning signal comprises a mechanical vibration component, then, in the step 331, a mechanical vibrator is activated. The mechanical vibrator can be useful in cases wherein a driver is deaf or hard of hearing.

Figure 4:
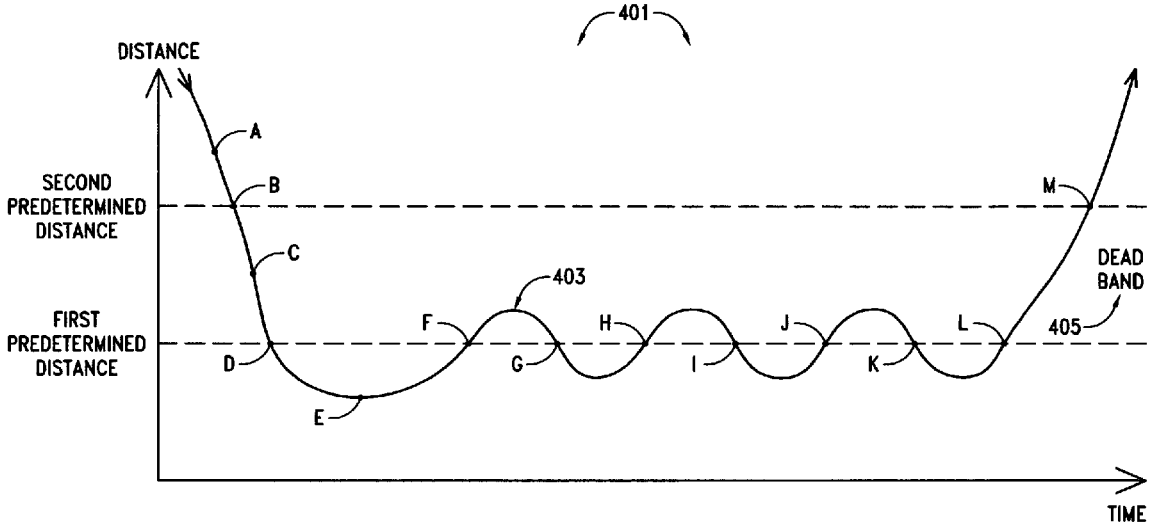
FIG. 4 is a graphical illustration of a dead-band formed by the method described in FIG. 3.

FIG. 4 depicts a distance vs. time graph 401 illustrating the "Dead Band" formed by the conjunction of steps 307, 308 and 309 in FIG. 3. The vertical axis of the graph represents a distance between the emergency vehicle and the first vehicle, shown in FIG. 1 as either a straight line distance Z, or the actual highway distance between the vehicles, represented by X+Y. The horizontal axis of the graph of FIG. 4 represents time. The meandering line 403 represents the distance between the first vehicle 101 and the emergency vehicle 103 as a function of time. At point A, the distance is greater than the first or second predetermined distances. At this distance, the functional circuit 115 is therefore not activated to transmit a warning signal to an audio speaker, graphic visual display, or vibrator, nor is the functional circuit activated to decrease the volume of a user-selected sound being broadcast over audio speaker 113. The Emergency Vehicle Present Bit 513 within the functional circuit 115 is off at this time, and will remain off as the vehicular distance passes from point A, through point B and to point C on the graph.

As the distance between the vehicles 101, 103 passes within the first predetermined distance at point D of graph 401, the Emergency Vehicle Present Bit 513 within the function circuit is turned "on" and the functional circuit 115 activates the warning signal. The warning signal functions variously to decrease a volume of a user selected sound within the first vehicle, and/or activate some or all of the warnings, as described in conjunction with steps 317, 323, 327 and 331 of FIG. 3. The Emergency Vehicle Present Bit remains on, and the warning functions associated therewith, remain active while the a distance between the vehicles is within the first predetermined distance at points E and F.

The dead band 405 is defined as the region between the first predetermined distance and the second predetermined distance. As discussed in conjunction with FIG. 3, when the Emergency Vehicle Present Bit 513 is off, and the vehicular separation distance is greater than the second predetermined distance, the Emergency Vehicle Present Bit will not turn "on" as a result of the vehicular separation distance crossing into the dead band. However, when the vehicular separation distance has come inside of the first predetermined distance, the Emergency Vehicle Present Bit will turn "on." Thereafter it will not turn off simply by crossing into the dead band. The vehicular separation distance must exceed the second predetermined distance to cycle the Emergency Vehicle Present Bit from "on" to "off."

Without a dead band formed by the addition of a second predetermined distance, as the distance between the vehicles crossed point F on the graph 401, and again exceeded the first predetermined distance, the Emergency Vehicle Present Bit 513 would turn off, along with the warnings associated therewith. This process can be appreciated by reviewing the steps of FIG. 3. Within FIG. 4, the region from point F to point L would produce rapid on-off cycling of the warnings controlled by the functional circuit 115 in the absence of a dead band. This could occur, for example, in circumstances wherein the first vehicle and the emergency vehicle were traveling on parallel highways and separated by a distance approximating the first predetermined distance. Slight deviations in the distance between the vehicles would result in the warning signal oscillating on and off. Rapid cycling of the warning indicator(s) between an off-state and an on-state would be annoying, and potentially confusing to the driver 107.

The implementation of a dead band reduces such rapid cycling of the audio, visual and mechanical warning systems discussed herein. The implementation of a dead-band, however, is exemplary, and embodiments are envisioned incorporating only a single predetermined distance for cycling a warning on and off.

FIG. 5 depicts an apparatus for warning the driver 109 of a first vehicle 101 that an emergency vehicle 103 is traveling proximate the first vehicle. A transmitter 501 within the emergency vehicle functions to transmit a Vehicle Present Signal 502. A receiver 503 within the first vehicle 101 is configured to receive the Vehicle Present Signal.

When the Vehicle Present Signal is received by the receiver 503, the digital data therein is processed by a microprocessor 507 that is in signal continuity with the receiver 503. The processed data is then stored in digital storage member 509 that is electrically coupled to the microprocessor. The Emergency Vehicle Present Bit 513 discussed in conjunction with FIGS. 3 & 4 is shown within the digital storage member in an exemplary true state as illustrated by the value "1". The warning signal is transmitted along the data bus 511, which electrically couples the microprocessor 507 to the audio system 111, the warning light 118, the graphic visual display system 117, and/or the mechanical vibrator 119. The reference to a data bus 511 herein is exemplary. As discussed in conjunction with FIG. 2, any signaling path embodiment discussed herein is exemplary. Although the method and apparatus described in conjunction with FIG. 5 is described largely in terms of digital signals, digital processing, and digital storage devices, these details are exemplary. The appended claims comprehend alternative embodiments utilizing analog signals and circuitry.

The foregoing description is directed to a method and apparatus for warning a driver of a first vehicle that an emergency vehicle is proximate the first vehicle. A transmission of a Vehicle Present Signal by the emergency vehicle can be digital or analog, and can be comprised of a variety of data, including the type of emergency vehicle, the location, speed and direction of travel of the emergency vehicle, and data of the local highways and other local landmarks and terrain features. The Vehicle Present Signal is received by the first vehicle, and the data is analyzed. If the functional circuit within the first vehicle determines that the emergency vehicle is within a predetermined distance of the first vehicle, the functional circuit transmits a warning signal designed to warn the driver that an emergency vehicle is proximate. The warning signal can initiate a variety of warning mechanisms, including, but not limited to, a reduction of volume of a stereo or other user-selected audio broadcasts, the broadcast of an audio warning over an audio system in the first vehicle, activation of a warning light, the display of visual information on a graphic visual display system within the first vehicle, the activation of a mechanical vibrator within the first vehicle, and combinations thereof. A dead band defined by first and second predetermined distances can be implemented to prevent rapid cycling of the various warning mechanisms used in conjunction with the warning system.

Throughout this disclosure, many specific details commonly known to those skilled in the art have been omitted so as to not unnecessarily obscure the novel features of the claimed invention. Conversely, many details have been included for exemplary purposes that are not essential to the operation of the invention. For example, various calculations and information processing steps described herein as being performed by the first vehicle could equally be performed by the emergency vehicle and transmitted to the first vehicle as necessary. Similarly, steps describing the downloading of local maps and topographical information to the emergency vehicle and subsequently transmitted from the emergency vehicle to the first vehicle can also be done by downloading such topographical information to the first vehicle from another location, including, but not limited to wireless transmission from a base-station transmitter or orbiting satellite, or download from a fixed recording media electrically coupled to the functional circuit of the first vehicle. Accordingly, these, and many other specific details recited herein are for exemplary purposes, and are not intended to limit the spirit and scope of the appended claims, which embrace the widest application consistent with the spirit and scope of the invention described herein.

We claim:

1. A method of warning a driver within a first vehicle of an emergency vehicle proximate said first vehicle, the method comprising the steps:

generating a Vehicle Present Signal from outside the first vehicle;

receiving said Vehicle Present Signal by a receiver within said first vehicle;

determining, from the Vehicle Present Signal, a distance between said emergency vehicle and said first vehicle;

activating a warning system within the first vehicle to an on-state if the distance is less than or equal to a first predetermined distance; and, governing the warning system by a governing circuit that includes a dead band defined by upper and lower limits respectively corresponding to the first predetermined distance and a second predetermined distance greater than the first predetermined distance, the step of governing the warning system including the step of preventing the warning system from cycling from the on-state to an off-state when a distance between the first vehicle and the emergency vehicle transitions from a distance less than or equal to the first predetermined distance to a distance within the dead band greater than the first predetermined distance.

2. The method according to claim 1 wherein the distance from the first vehicle to the emergency vehicle is determined according to a straight line distance between the emergency vehicle and the first vehicle.

3. The method according to claim 1 wherein the distance from the first vehicle to the emergency vehicle is determined according to the shortest path between the first vehicle and the emergency vehicle over existing highways.

4. The method according to claim 2 wherein the step of determining a distance comprises the step of measuring a signal strength of said Vehicle Present Signal.

5. The method according to claim 1 wherein the step of determining a distance comprise the steps: i) defining a first coordinate position of said first vehicle; ii) defining a second coordinate position of said emergency vehicle; and, iii) determining a distance from said first coordinate position to said second coordinate position.

6. The method according to claim 1 further comprising the steps:

cycling the warning system from an on-state to an off-state when the distance between the first vehicle and the emergency vehicle transitions from a distance within the dead-band to a distance greater than the second predetermined distance.

7. The method according to claim 1 wherein the Vehicle Present Signal comprises data selected from among a group of data consisting of a type of emergency vehicle, a location of the emergency vehicle, a speed of the emergency vehicle, direction of travel of the emergency vehicle, and topographical details.

8. The method according to claim 7 wherein the topographical details comprise information of roads, highways, bridges, overpasses, underpasses, highway construction, one-way streets, railroads, buildings, landmarks, and combinations thereof.

9. The method according to claim 1 wherein activating a warning system within the first vehicle includes activating a warning system selected from among a group of warning systems consisting of a visual warning, an audio warning, a mechanical warning, or combination thereof.

10. The method according to claim 9 wherein the step of warning the driver with a visual warning comprises the step of activating a warning light.

11. The method according to claim 9 wherein the step of warning the driver with a visual warning comprises the step of activating a range-and-bearing display that includes a position of the first vehicle, and a position of the emergency vehicle relative to the first vehicle.

12. The method according to claim 8 wherein warning the driver with a visual warning comprises activating a visual display consisting of graphic data, text data, or combinations thereof.

13. The method according to claim 12 wherein activating a graphic visual display comprises activating a display of graphic visual images selected from among a group of graphic visual images consisting of topographical details, a position of the first vehicle relative to the topographical details, a type of emergency vehicle, a location of the emergency vehicle relative to the topographical details, a direction of travel of the emergency vehicle, and combinations thereof.

14. The method according to claim 9 wherein the step of warning the driver with a visual warning comprises displaying alpha numeric data selected from among a group of data consisting of a type of emergency vehicle, a distance between said emergency vehicle and said first vehicle, a speed of said emergency vehicle, a quantity of emergency vehicles proximate the first vehicle, and combinations thereof.

15. The method according to claim 9 wherein an audio speaker is disposed within said first vehicle, the step of warning the driver with an audio warning comprising the steps: i) transmitting a warning signal to said audio speaker; and, ii) broadcasting a warning from said audio speaker.

16. The method according to claim 9 wherein said audio warning includes an audio description of a type of emergency vehicle.

17. The method according to claim 9 wherein said audio warning includes an audio description of a space-time relationship between said first vehicle and said emergency vehicle.

18. The method according to claim 17 wherein said space-time relationship is selected from among a group of space-time relationships consisting of a straight line distance between said first vehicle and said emergency vehicle, an intersect distance between said first vehicle and said emergency vehicle over existing highways, a direction of said emergency vehicle relative to said first vehicle, a speed of said emergency vehicle relative to the earth, a speed of said emergency vehicle relative to said first vehicle, and combinations thereof.

19. The method according to claim 15 wherein a user selected sound is being broadcast to the audio speaker at a first volume prior to the step of determining a distance between said emergency vehicle and said first vehicle, the step of warning the driver with an audio warning comprising the step of reducing said user selected sound to a second volume that is less than said first volume.

20. The method according to claim 19 wherein the step of reducing said user-selected sound to a second volume is performed by a functional circuit.

21. The method according to claim 9 wherein the step of warning a driver comprises activating a mechanical vibrator.

22. The method according to claim 13 wherein the topographical details are selected from among a group of details consisting of the type of emergency vehicle, roads, highways, bridges, overpasses, underpasses, highway construction, railroads, buildings, landmarks, and combinations thereof.

23. An apparatus for warning a driver controlling a first vehicle of an emergency vehicle proximate said first vehicle, said apparatus comprising:

a) a signal-generator located outside the first vehicle for generating a Vehicle Present Signal;

b) a signal-receiver coupled to said first vehicle for receiving said Vehicle Present Signal;

c) a warning device within the first vehicle, said warning device configured to transition between on and off states; and, d) a functional circuit coupled to said signal-receiver, including a range-finder for determining a distance from said first vehicle to said emergency vehicle, the functional circuit further comprising a control circuit for controlling the warning device, the control circuit including a dead band having a lower limit corresponding to a first predetermined distance between the first vehicle and the emergency vehicle, and an upper limit corresponding to a second predetermined distance between the first vehicle and the emergency vehicle, the second predetermined distance being greater than the first predetermined distance, said control circuit being configured to cycle said warning device from an off-state to an on-state when a distance between the emergency vehicle and the first vehicle transitions from a distance greater than the first predetermined distance to a distance less than or equal to the first predetermined distance.

24. The apparatus according to claim 23 wherein said range-finder is configured to measure the signal strength of said Vehicle Present Signal.

25. The apparatus according to claim 23 wherein said range finder includes a digital circuit for determining a distance between a first and second set of coordinates.

26. The apparatus according to claim 23 wherein the range finder includes a global positioning system.

27. The apparatus according to claim 26 wherein the global positioning system is selected from among a group of global positioning systems consisting of Doppler satellite global positioning systems, Loran global positioning systems, Omega global positioning, cell triangulation positioning systems, and combinations thereof.

28. The apparatus according to claim 23, wherein the warning device comprises a visual indicator selected from among a group of visual indicators consisting of a warning light, a range and distance display, a road map, a topographical display, a graphical icon indicating a type of emergency vehicle, and combinations thereof.

29. The apparatus according to claim 23, wherein the warning device comprises an audio device including an audio-signal generator, an audio-speaker, and a signal path having electrical continuity from said audio-signal generator to said audio-speaker, said functional circuit configured to control a signal produced by said audio-generator.

30. The apparatus according to claim 23 wherein said functional circuit comprises a digital storage member for storing digital data, and a processing member for processing said digital data.

31. The apparatus according to claim 30, wherein said digital data includes data selected from among a group of data consisting of a type of emergency vehicle, a position of said emergency vehicle, a distance between said first vehicle and said emergency vehicle, a location of said emergency vehicle relative to said first vehicle, a recommended course of action for said first vehicle, data of streets proximate said first vehicle, data of a street location of said first vehicle, data of a street location of said emergency vehicle, the first predetermined distance, the second predetermined distance, and combinations thereof.

32. The apparatus of claim 23, the control circuit configured to prevent the warning device from cycling from the on-state to the off-state if a distance between an emergency vehicle and the first vehicle corresponds to a distance within the dead band.

* * * * *